US006976768B2

(12) United States Patent
Hewson

(10) Patent No.: US 6,976,768 B2
(45) Date of Patent: Dec. 20, 2005

(54) INFINARIUM

(76) Inventor: Alan Hewson, 102 Christopher St. #2A, New York, NY (US) 10014

( * ) Notice: Subject to any disclaimer, the term of this patent is extended or adjusted under 35 U.S.C. 154(b) by 157 days.

(21) Appl. No.: 10/385,780

(22) Filed: Mar. 11, 2003

(65) Prior Publication Data

US 2004/0047150 A1 Mar. 11, 2004

Related U.S. Application Data

(60) Provisional application No. 60/362,895, filed on Mar. 11, 2002.

(51) Int. Cl.[7] ..... F21S 2/00

(52) U.S. Cl. ..... 362/247; 362/227; 362/241

(58) Field of Search ..... 362/227, 234, 362/235, 236, 237, 240, 241, 243, 245, 247, 248, 363, 299, 297, 300, 800

(56) References Cited

U.S. PATENT DOCUMENTS 4,695,929 A * 9/1987 Smith ..... 362/140
5,297,012 A * 3/1994 Fletcher ..... 362/252

FOREIGN PATENT DOCUMENTS

GB 2053546 A * 2/1981

* cited by examiner

*Primary Examiner*—Thomas M. Sember
*Assistant Examiner*—Bao Q. Truong

(57) ABSTRACT

A novelty lamp in the shape of an equilateral pyramid of any size, containing two discrete interior chambers, one being a light chamber, the enclosed space of the light chamber containing at least 10 point light sources, and a reflection chamber, used to reflect and admit the above light sources.

10 Claims, 7 Drawing Sheets

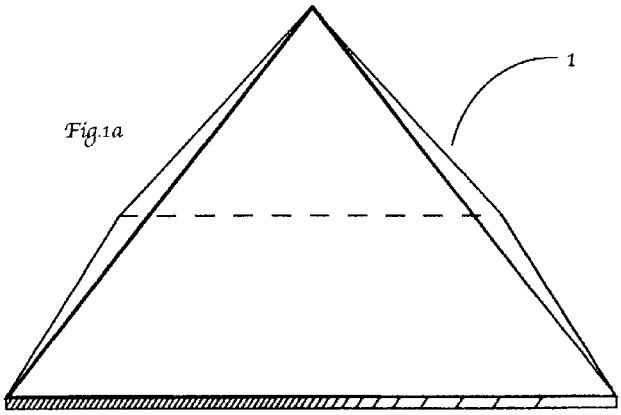
Fig.1a
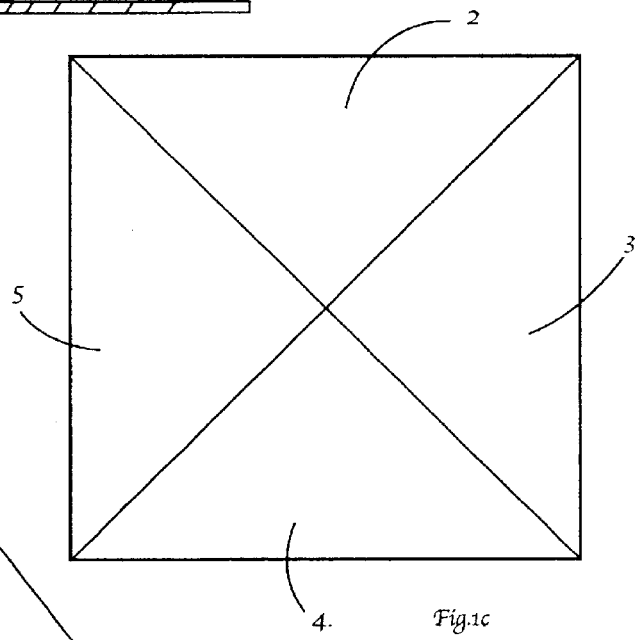
Fig.1c
Fig. 1b
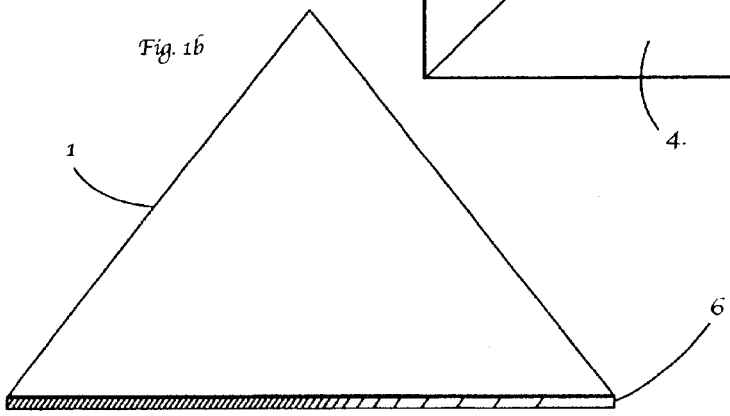

Fig 5a
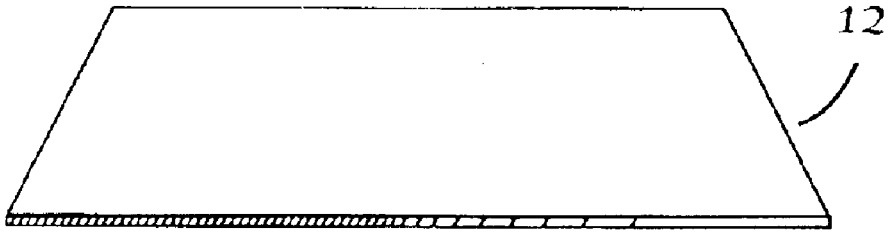
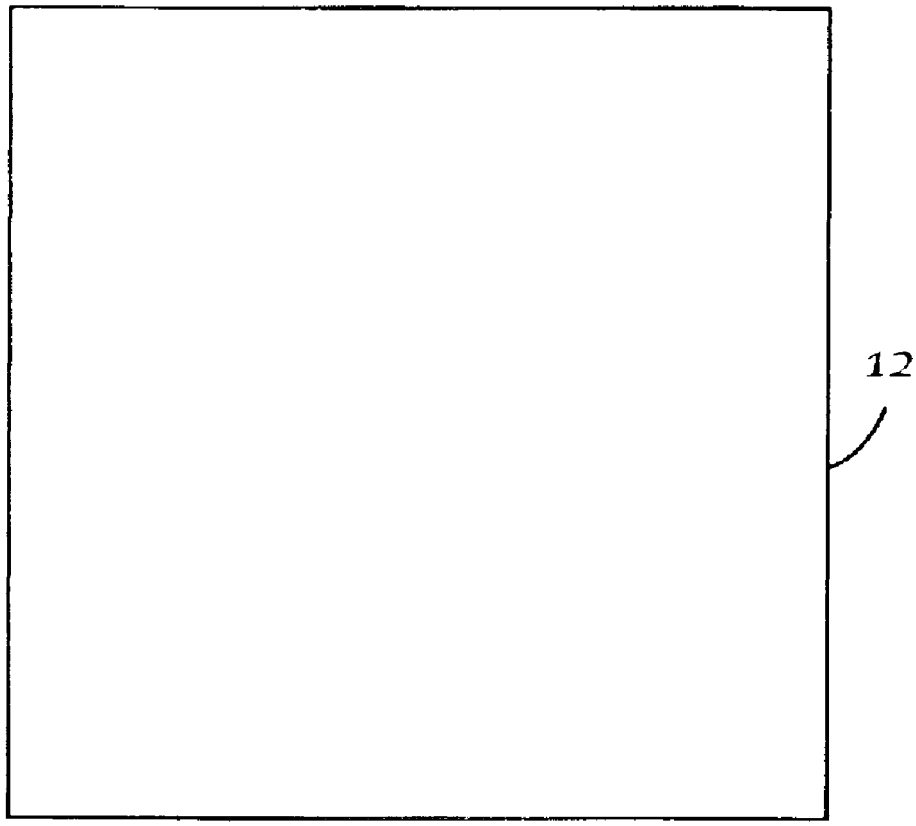
Fig.5b

INFINARIUM

CROSS-REFERENCE TO RELATED APPLICATIONS

This application claims the benefit of PPA Ser. No. 60/362,895 filed Mar. 11, 2002.

FEDERALLY SPONSORED RESEARCH

N/A

SEQUENCE LISTING OR PROGRAM

N/A

BACKGROUND OF THE INVENTION

This invention relates to novelty lamps, specifically a lamp that virtually creates a visual representation of an infinite starfield within a pyramid form.

BACKGROUND

In my searching, I was unable to find any prior references to a novelty lamp that attempts to display a virtual recreation of infinity.

OBJECTS AND ADVANTAGES

The Infinarium accomplishes the goal of displaying in a finite space, a virtual representation of an infinite starfield. The Infinarium is a novelty lamp made strictly for entertainment and amusement purposes.

SUMMARY

In accordance with the present invention Four transparent, equilateral, triangular walls of a predetermined thickness, each said wall having a two way mirrored surface, each said wall being disposed adjacent to each other and inclining on a plane intersecting at a common apex, and by doing so, forming an equilateral pyramid structure, which is placed on an equilateral square base aligned along a common meridian with said pyramid structure, and by doing so, enclose a space within which is constructed a rectangular box with a two way mirrored top that when, attached to said base, encloses a space wherein a plurality of light sources is placed and a separate interior space that acts as a reflection chamber.

DRAWINGS—FIGURES

FIGS. 1A to 1C show various views of the invention in its completed form.

FIGS. 5A and 5B show the top plate in perspective and top views.

DETAILED DESCRIPTION—FIGS. 1A, 1B AND 1C—PREFERRED EMBODIMENT

Figure 2A:
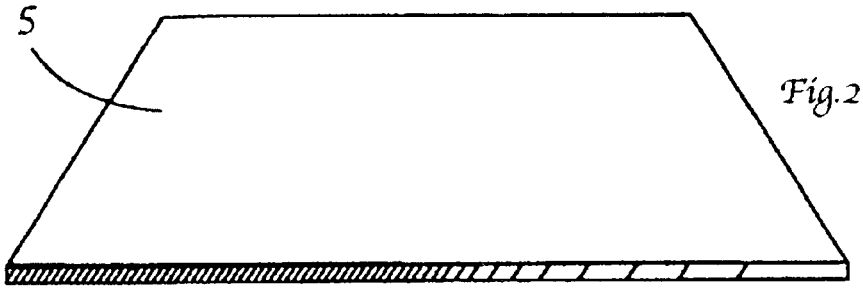
FIGS. 2A and 2B show the bottom plate.

The preferred embodiment of the shape of the present invention is illustrated in FIG. 1A (perspective view), FIG. 1B (side view) and FIG. 1C (top view). The novelty lamp is constructed of four equilaterally triangular side panels 2, 3, 4, 5. FIG. 1C. These four panels are arranged in at right angles to each other, and share a common apex, and could be glued or bonded together to form an equilateral, 4 sided pyramid structure 1 FIG. 1A, and in a preferred embodiment, a four sided, equilateral pyramid is molded or cast in one piece.

The pyramid structure 1 is constructed of plexiglas, glass, plastic or any suitable transparent material, to which, a two way mirrored surface is applied. The side panels, 2, 3, 4, 5 FIG. 1C, are of a predetermined thickness, proportionally based on the height of the finished pyramid structure 1. In one 12 inch square base embodiment of the invention, the side panels could range from ⅛th inch in thickness, to ½ inch in thickness, and this proportional relationship is scalable, and could be applied to any construction of the invention of any size.

The pyramid structure 1, as described above, rests precisely on a base plate 6 as illustrated in FIG. 1B. This base plate is equal in horizontal dimensions to the horizontal dimensions of the base of the pyramid structure 1. Both the pyramid structure I and the base plate 5 are aligned together so as to align completely and perfectly along a common meridian, and in doing so, form an enclosed structure.

Figure 2B:
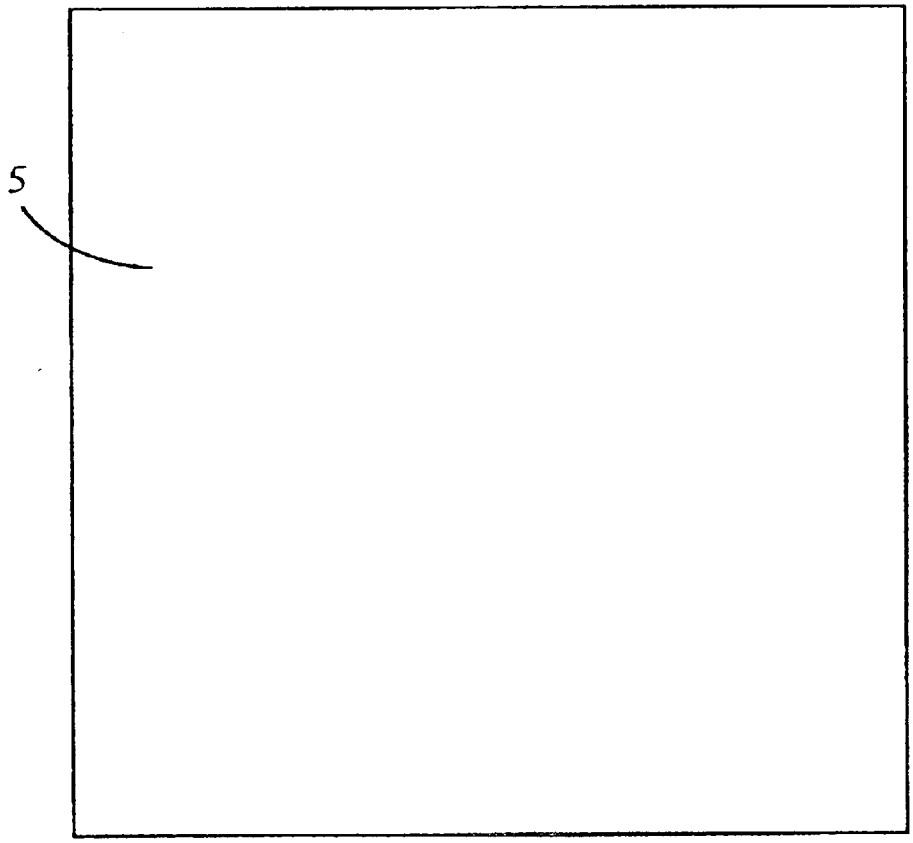
Figure 3:
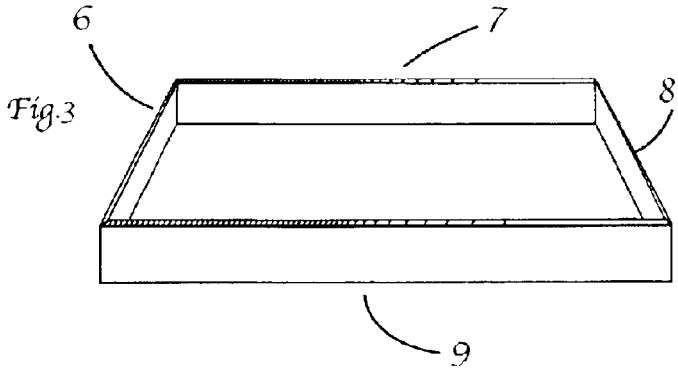
FIG. 3 is a perspective view of the square enclosure that forms the sides of the light chamber.

FIG. 2A, is a perspective view of the base plate 5, illustrating the preferred spacial relationships between height, width and depth of the base plate 5. The base plate could be constructed of plastic, metal, glass, wood or any other suitable material that is completely opaque, and rigid in nature. In FIG. 2*b*, (top View) the equilaterally square horizontal dimensions of the base plate 5 are illustrated.

Figure 4A:
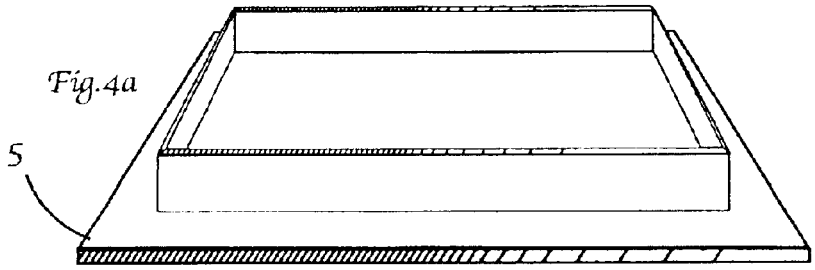
FIGS. 4A and 4B show the base plate structure in perspective and top view.

An equilaterally square enclosure 10 as shown in FIG. 4A, is constructed of 4 side panels, 6,7, 8, 9 of equal length, height, and width are joined together with 45 degree angle beveled joins, at right angles to each other, and sharing a common horizontal plane. These 4 side panels, 6, 7, 8, 9 are constructed of any totally opaque, rigid material notably plastic, metal, glass, stone or wood, and preferred horizontal height is approximately 15 percent of the height of the pyramid structure 1 from base to apex, and could be any height from 10 percent up to and including 20 percent of he height of the pyramid structure 1.

Figure 4B:
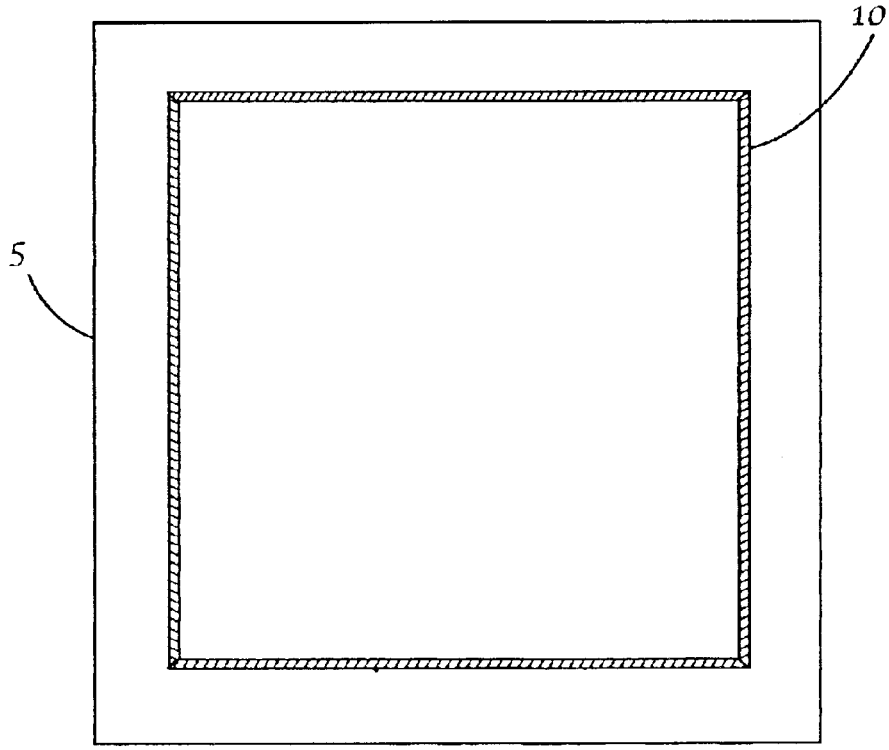

Illustrated in FIG. 4A is the placement for attachment, preferably by gluing, bonding, molding or casting of the base plate 5, FIG. 2A, and the square enclosure 10, which sits on the upper horizontal side of the base plate 5, equidistantly from the 4 outer edges of the base plate 5. The preferred placement of the square enclosure 10, equidistantly positioned from the four outer edges of the base plate 5 is illustrated in FIG. 4B. The resulting structure is called the base plate structure 11.

The top plate 12 is illustrated in FIG. 5A, and is used to define, separate and enclose two interior spaces, the light chamber 14 and the reflection chamber 15, and is preferably made of transparent plastic or glass to which a two way mirrored surface has been applied. The preferred size of the top plate 12 is approximately 80 percent of the horizontal surface area of the base plate 5, and could be any percentage between 70 percent and 90 percent of the base plate 5, and still function correctly. FIG. 6B is a top view, illustrating the equilateral square horizontal dimensions of the top plate 12.

Figure 6A:
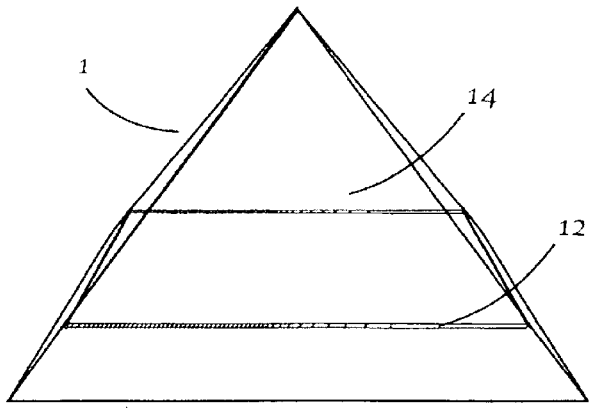
FIGS. 6A to 6C show the top structure in perspective, side and top views.
Figure 6B:
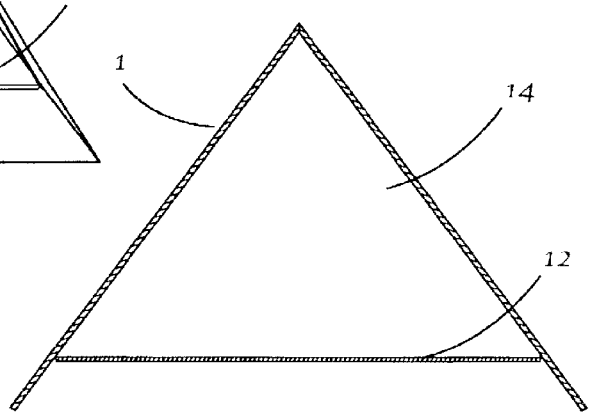

The top plate 12, is then attached by any suitable method permanently to the interior walls of the pyramid structure 1 as illustrated in FIG. 6A. (front perspective view) on the same horizontal plane as the base plate 5. The resulting structure is called the top structure 13 and this results in the creation of the reflection chamber 14 which is the interior space enclosed by the above construction. The placement of the top plate 12 as illustrated in FIG. 6B (side view) is such that when the top structure 13 is placed on the base plate structure 11 and aligned perfectly along a common meridian, the result being the total enclosure and creation of the light chamber 14 as illustrated in FIG. 6A.

Figure 6C:
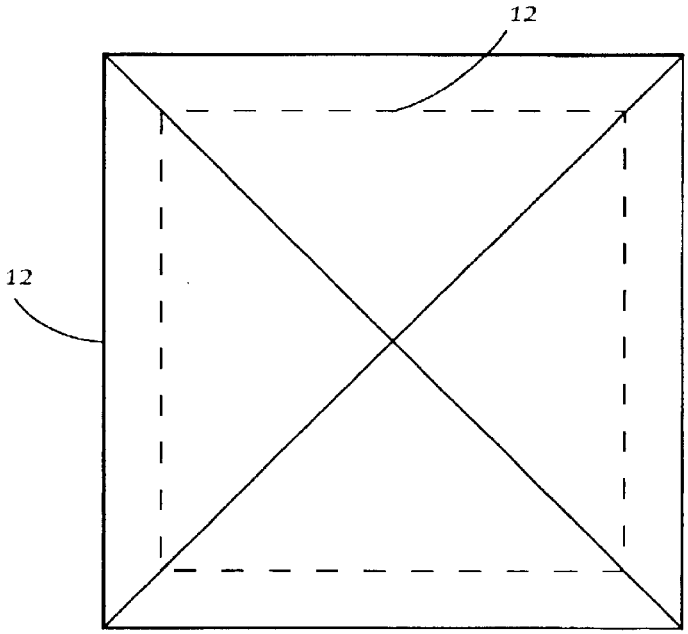

The relationship between the height of the sides of the square enclosure 10 and the position of the placement of the top plate 12 in the pyramid structure 1 is such that 3. when the base plate structure 11 and the top structure 13 are assembled, the top plate 12 intersects the top sides of the square enclosure 10 and encloses the interior space, creating the light chamber 14 as illustrated in FIG. 6B. The illustration in FIG. 6C. is a top view, showing the placement and horizontal dimensions of the top plate 12 relative to the to the base plate 5.

Figure 7A:
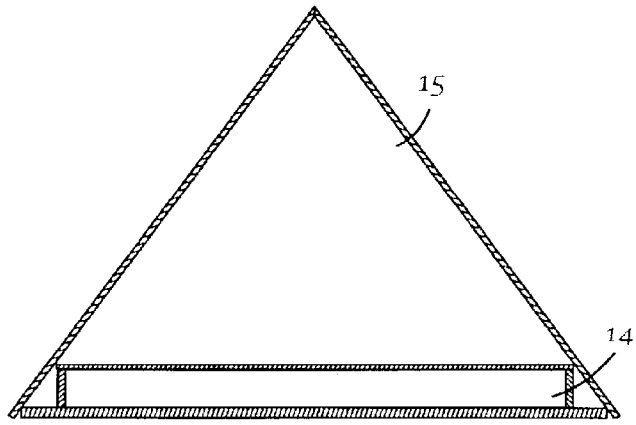
FIGS. 7A and 7B show the completed Infinarium superstructure in top and perspective views.
Figure 7B:
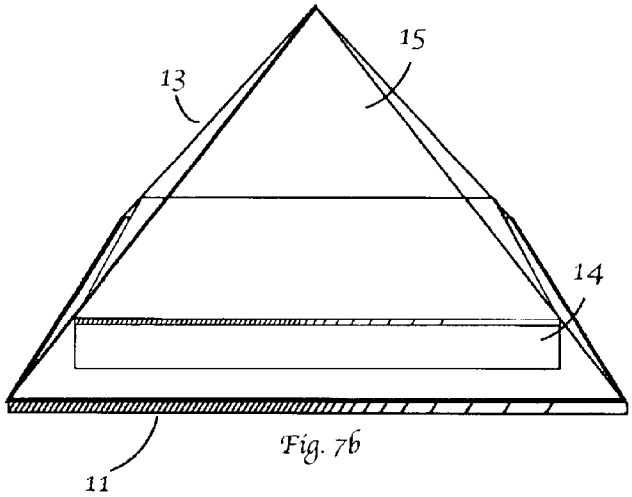

The base plate structure 11 and the top structure 13, when placed together so that the base corners and sides align perfectly with each other, form the completed superstructure of the preferred embodiment of the invention. as illustrated in FIG. 7B and in doing so complete and enclose both the light chamber 14 and the reflection chamber 15.

Figure 8:
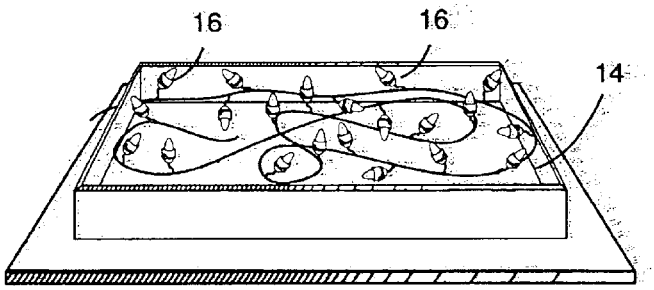
FIG. 8 shows the base structure with a sample lighting assembly in place.

As illustrated in FIG. 8, a plurality of point light sources 16 not less than 10 in quantity, are positioned in either a random or specified order within the light chamber 14 prior to placing the top structure 13. These point lights 16 are of a size that is relative to the overall dimensions of the invention, and could be any type and size of light or lamp from ⅛ inch light emitting diodes up to and including 10 inch diameter incandescent light bulbs.

Figure 9:
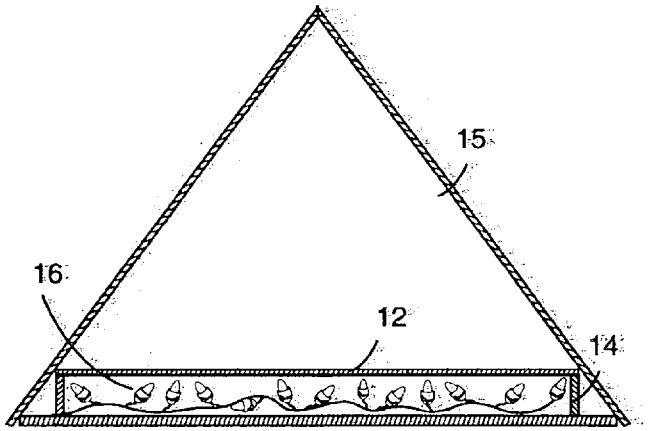
FIG. 9 shows a cutaway view of a finished structure.
Figure 10:
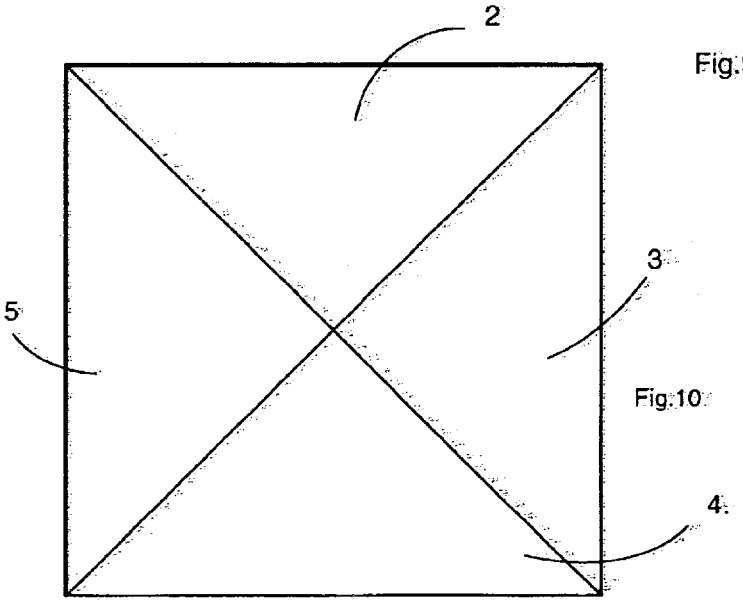
FIG. 10 shows a finished structure top view.

FIG. 9 shows a cutaway view of the completed invention, illustrating a cross section of the reflection chamber 15 and the light chamber 14. with the positioned light sources 16. The light emanating from the point light sources 16 that is admitted through the top plate 12, enters the reflection chamber 15, where the light is reflected off of and or admitted from the two way mirrored, inclined planes of the side panels 2, 3, 4, 5, FIG. 10 and the horizontal plane of the top plate 12, reflecting and admitting the light in infinite, non linear progressive repetitive reflections and admitances that diminish in intensity with each progressive reflection and admitance.

The overall effect that is achieved by the construction of the invention and the physics of light and reflection, is a virtual, visual recreation of an infinite starfield, or universe, encapsulated within the finite space enclosed within the reflection chamber 15 The invention could be constructed to any size, as long as the spacial relationships between the elements illustrated above are consistently maintained.

I claim:

1. A novelty lamp comprises four transparent, equilateral, triangular walls of a predetermined thickness, each said wall having a two way mirrored surface, each said wall being disposed adjacent to each other and inclining on a plane intersecting at a common apex, and by doing so, forming an equilateral pyramid structure, which is placed on an equilateral square base aligned along a common meridian with said pyramid structure, and by doing so, enclose a space within, which is constructed a rectangular box having a two way mirrored top, which is attached to said base, the rectangular box encloses a space, wherein a plurality of light sources is placed and a separate interior space that acts as a reflection chamber.

2. A novelty lamp of claim 1 wherein said pyramid structure sits upon and/or is attached to said equilateral square base, which is the exact linear dimensions of the linear space created by the intersection of the bottom edges of said pyramid structure, both said base plate and said pyramid structure aligned along a common meridian.

3. A novelty lamp of claim 1 wherein said square base plate is constructed of any opaque material of sufficient thickness to support said pyramid structure consisting of wood, metal, plastic, glass or stone.

4. A novelty lamp of claim 1 wherein the rectangular box is constructed of four equal side panels, placed perpendicularly to the horizontal plane of said square base and joined to each other at right angles relative to each other, and in doing so, form an equilateral square structure.

5. A novelty lamp of claim 4 wherein said equilateral square structure is attached to the top side of said base plate equidistantly from the outer edges of said base plate and aligned along a common meridian of said base plate and said equilateral square structure, forming a base structure; said side panels are approximately fifteen percent of the height of said pyramid structure, measured vertically from apex to base, and are constructed of a totally opaque material consisting of metal, plastic, glass, or stone; the thickness of said side panels could be any thickness between one sixteenth inch thick and two inches thick and is relative and proportional to the size of said pyramid structure.

6. A novelty lamp of claim 4 wherein said equilateral square structure is enclosed by a transparent top plate, made preferably of but not limited to plastic or glass, and to which a two way mirrored surface is applied and the linear dimensions of said top plate are an equilateral square that is approximately eighty percent of the linear dimensions of said base plate, with a thickness between one sixteenth inch and two inches thick and is relative and proportional to the size of said pyramid structure.

7. A novelty lamp of claim 6 wherein said top plate is attached to the inner sides of said pyramid structure on a horizontal plane that is measured to precisely intersect said inner equilateral square structure when said base plate structure and said pyramid structure are aligned precisely along a common meridian and thus, forms a top structure, and in doing so, encloses an interior space within the pyramid structure, called an inner chamber.

8. A novelty lamp of claim 1 wherein said reflection chamber is created when said pyramid structure and said base plate structure are placed precisely along a common meridian, and an inner top plate of said reflection chamber intersects side panels perpendicularly, the resulting enclosed space creates the reflection chamber.

9. A novelty lamp of claim 1 wherein the plurality of appropriately sized point light sources ranging from but not limited to 0.05 millimeter light emitting diodes up to and including 10 inches diameter incandescent light bulbs, or any point light sources available, are interspersed in either a particular order or a random order within said light chamber.

10. A novelty lamp of claim 8 wherein the light sources are reflected and admitted through said side panels and said top plate in a non-linear, non-repetitive pattern of progressively diminishing intensity; whereas the effect of the lamp displayed to external viewers is that of a virtual recreation of an infinite star field within a finite pyramidal structure.

* * * * *